United States Patent [19]

Kimura et al.

[11] Patent Number: 4,980,603

[45] Date of Patent: Dec. 25, 1990

[54] CATHODE FOR AN ELECTRON TUBE

[75] Inventors: Etsuji Kimura, Saitama; Hisao Nakanishi, Kyoto, both of Japan

[73] Assignees: Mitsubishi Kinzoku Kabushiki Kaisha; Mitsubishi Denki Kabushiki Kaisha, both of Tokyo, Japan

[21] Appl. No.: 204,818

[22] Filed: Jun. 10, 1988

[30] Foreign Application Priority Data

Jun. 12, 1987 [JP] Japan ..... 62-146643
Jun. 12, 1987 [JP] Japan ..... 62-146644

[51] Int. Cl.[5] ..... H01J 1/14
[52] U.S. Cl. ..... 313/346 R
[58] Field of Search ..... 313/346 R

[56] References Cited

U.S. PATENT DOCUMENTS 4,007,393 2/1977 van Stratum et al. ..... 313/346 R
4,625,142 11/1986 Esdonk et al. ..... 313/346 DC
4,797,593 1/1989 Saito et al. ..... 313/346 R
4,864,187 9/1989 Kinjiro et al. ..... 313/346 R
4,873,052 10/1989 Hasker et al. .

FOREIGN PATENT DOCUMENTS 0204477 12/1986 European Pat. Off. .
0210805 2/1987 European Pat. Off. .
61-269828 11/1986 Japan .
61-271732(A) 12/1986 Japan .
62-22347(A) 1/1987 Japan .
62-88239(A) 4/1987 Japan .
2012103A 11/1978 United Kingdom .

OTHER PUBLICATIONS

"Electron Emission Properties and Surface Atom Behavior of Impregnated Cathodes With Rare Earth Oxide Mixed Matrix Base Metals" of Yamamoto et al., pp. 69–83, (Jul. 1984).

*Primary Examiner*—Palmer C. DeMeo
*Attorney, Agent, or Firm*—Lowe, Price, LeBlanc, Becker & Shur

[57] ABSTRACT

A cathode for an electron tube comprises a base (1) including nickel as a major element and including at least silicon as a reducing element, and it further comprises an electron-emissive layer (5) coated on the base, including not only alkaline earth metal oxide (8) containing at least barium but also scandium oxide. The scandium oxide (4) is in the form of dodecahedral or prismatic polyhedral crystals and dispersed in the electron-emissive layer in the range from 0.1 to 20 wt. %.

7 Claims, 7 Drawing Sheets

20μm

20μm

20μm

CATHODE FOR AN ELECTRON TUBE

BACKGROUND OF THE INVENTION

1. Field of the Invention

This invention relates to a cathode for an electron tube such as a cathode ray tube and particularly to an improvement in electron emission characteristics of the cathode.

2. Description of the Prior Art

In the prior art, a most commonly used cathode for an electron tube such as a picture tube is the so-called oxide cathode in which an alkaline earth metal oxide layer containing Ba is formed on a base of Ni as a major element containing a small amount of a reducing agent such as Si or Mg.

An electron-emissive layer of such an oxide cathode is an oxide layer obtained by conversion through thermal decomposition of an alkaline earth metal carbonate. Thus, the oxide is caused to react with the reducing agent so that free metal atoms are generated to serve as donors for emission of electrons.

In the above described process, a carbonate, which is chemically stable, is used as the starting material instead of using BaO from the beginning. This is because Ba is very active and BaO is liable to react with moisture in the air to produce $Ba(OH)_2$, from which it would be difficult to obtain free Ba in an electron tube.

The carbonate includes a single component such as $BaCO_3$ or a multicomponent such as $(Ba,Sr,Ca)CO_3$. Since the fundamental process of forming donors through activation is common to both cases of the single component and the multicomponent, an example of using a single component carbonate will be described in detail hereinafter for easier understanding.

FIG. 1 is a schematic sectional view illustrating an example of a conventional oxide cathode. A cathode cylinder includes a cap formed of a base metal 1, and a cylinder 2, and a heater 3 is provided inside the cathode cylinder to heat the cathode. An electron-emissive layer 55 of BaO is formed on a surface of the base 1.

The electron emissive layer 55 is formed by a process as described below. A resin solution obtained by dissolution of nitrocellulose or the like into an organic solvent is mixed with $BaCO_3$ and then the mixture is put on the base metal 1 by such a method as spraying, electrodeposition or application.

The cathode thus formed is incorporated in an electron tube and then it is heated to about 1000° C. by the heater 3 in an evacuation process for evacuating the electron tube. Thus, $BaCO_3$ is thermally decomposed and converted to BaO as indicated by the following formula I.

$$BaCO_3 \rightarrow BaO + CO_2 \quad \text{(I)}$$

Gas of $CO_2$ produced by the reaction as well as other gases produced by thermal decomposition of nitrocellulose is removed outside the electron tube.

However, the above described process involves disadvantages that the reducing agent of Si or Mg having an important role in reduction is unavoidably oxidized in an oxidizing atmosphere of $CO_2$ or the like in the tube at the time of the reaction represented by the formula I and that the element Ni of the surface of the base metal 1 is also oxidized on that occasion.

FIG. 2 is an enlarged fragmentary sectional view illustrating an interface region between the base 1 and the electron-emissive layer 55 for explaining the interface region in detail. In general, BaO constituting the electron-emissive layer 55 is in the form of aggregates 9 of several μm to several tens of μm in size formed by gathering of small prismatic crystals 8. Desirable gaps 10 are provided between the respective adjacent aggregates 9 of the electron-emissive layer 55, which makes the layer 55 porous. The substance BaO reacts with the reducing agent of Si or Mg in the interface region 11 where the layer 55 and the base 1 are in contact, so that free Ba is produced. The reducing agent diffuses along grain boundaries 7 of Ni crystal grains 6 of the base 1 and reduction reactions II or III as expressed below occur near the interface region 11.

$$2BaO + Si \rightarrow 2Ba + SiO_2 \quad \text{(II)}$$

$$BaO + Mg \rightarrow Ba + MgO \quad \text{(III)}$$

The free Ba thus obtained serves as a donor for electron emission. At the same time, reaction represented by the following formula IV also occurs.

$$SiO_2 + 2BaO \rightarrow Ba_2SiO_4 \quad \text{(IV)}$$

Free Ba serving as a donor as described above is generated in the interface region between the electron-emissive layer 55 and the base 1 and it moves through the gaps 10 in the electron-emissive layer 55 and comes out on the upper surface of the layer so that electrons are emitted. However, since the donors are evaporated or are consumed as a result of reaction with residual gas such as Co, $Co_2$, $O_2$ or $H_2O$, it is necessary to constantly supply donors by making the reactions as expressed by the formulas II or III. Such a cathode is generally used at a high temperature of about 800° C. so that a good balance is maintained between the supply and the consumption of the donors.

However, reaction products 12 such as $SiO_2$ or $Ba_2SiO_4$ represented in the formula II or IV are generated in the interface region 11 during operation of the cathode: Consequently, the reaction products 12 are accumulated in the interface region 11 and the grain boundaries 7 increasingly during the operation of the cathode to form a barrier (generally called an interface layer) against Si or the like moving in the grain boundaries 7. As a result, the reaction becomes gradually slow, which makes it difficult to generate Ba as the donor. In addition, this interface layer has a high resistance value, causing obstruction to electron emission current.

In order to solve the above described difficulties, prior art documents such as Japanese Patent Laying-Open No. 269828/1986 or Japanese Patent Laying-Open No. 271732/1986 disclose the below described techniques making use of the formation of an electron-emissive layer including dispersed powder of $Sc_2O_3$, in which:

(1) a composite oxide (for example, $Ba_3Sc_4O_9$) produced as a result of reaction between $Sc_2O_3$ and an alkaline earth metal oxide is thermally decomposed during operation of a cathode so that free Ba as the donor is generated and supplied;

(2) free metal scandium (Sc) is used to enhance conductivity of the electron-emissive layer; and (3) reaction products such as $Ba_2SiO_4$ in the interface region are decomposed by Sc.

Thus, according to the above described prior art, a cathode for an electron tube can be operated with a high-current density by virtue of the electron-emissive layer including dispersed powder of $Sc_2O_3$; however, there are involved disadvantages such as variations in electron emission characteristics of the products manufactured. In addition, it sometimes happens that the powder of $Sc_2O_3$ is not sufficiently uniformly dispersed in the electron-emissive layer, making it difficult to obtain a sufficient amount of electron emission current.

SUMMARY OF THE INVENTION

The present invention has been accomplished to eliminate the above described disadvantages. Therefore, an object of the present invention is to provide a cathode for an electron tube in which an electron-emissive layer including uniformly dispersed $Sc_2O_3$ is provided, making it possible to ensure stable electron emission characteristics for a long period of time.

According to an aspect of the present invention, a cathode for an electron tube comprises: a base including nickel as a major element and including at least silicon as a reducing agent, and an electron-emissive layer coated on the base, including not only alkaline earth metal oxide containing at least Ba but also scandium oxide, the scandium oxide being dodecahedral crystals and being dispersed in the electron-emissive layer in the range from 0.1 to 20 wt. %.

According to another aspect of the present invention, a cathode for an electron tube comprises: a base including nickel as a major element and including at least silicon as a reducing agent, and an electron-emissive layer coated on the base and including not only alkaline earth metal oxide containing at least Ba but also scandium oxide, the scandium oxide being prismatic polyhedral crystals and being dispersed in the electron-emissive layer in the range from 0.1 to 20 wt. %.

The scandium oxide having a dodecahedral or prismatic polyhedral crystal structure, dispersed in the electron-emissive layer in the present invention never fills the gaps between the aggregates of the electron-emissive layer and it serves to prevent oxidation of the base metal when carbonate of the alkaline earth metal is decomposed to an oxide or when the oxide such as BaO is decomposed by reducing reaction. Furthermore, the scandium oxide serves to prevent formation of an interface layer of a composite oxide of the reducing agent near the interface region between the base metal and the electron-emissive layer, and thus the movement of free atoms such as Ba in the layer will never be obstructed.

These objects and other objects, features, aspects and advantages of the present invention will become more apparent from the following detailed description of the present invention when taken in conjuction with the accompanying drawings.

DESCRIPTION OF THE PREFERRED EMBODIMENTS

Figure 1:
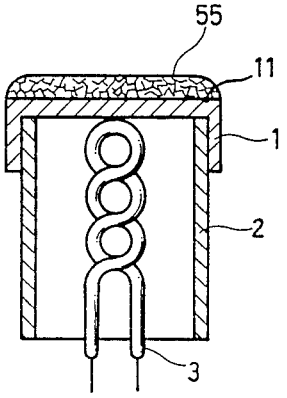
FIG. 1 PRIOR ART
FIG. 1 is a schematic sectional view of a conventional cathode for an electron tube.
Figure 2:
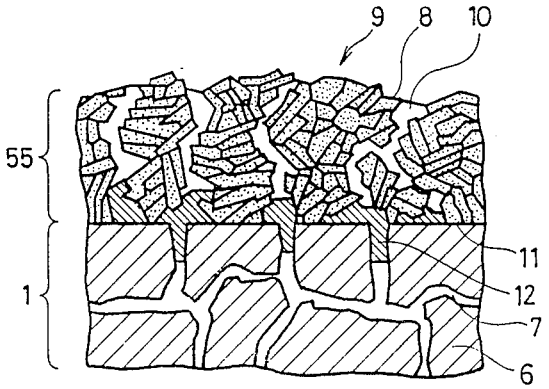
FIG. 2 PRIOR ART
FIG. 2 is an enlarged fragmentary sectional view of the conventional cathode.
Figure 3:
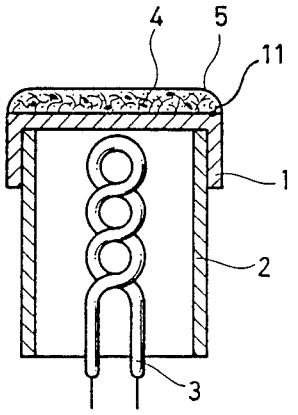
FIG. 3 is a schematic view of a cathode for an electron tube according to an embodiment of the present invention.

FIG. 3 is a schematic sectional view of a cathode for an electron tube according to an embodiment of the present invention. A heater 3 is provided in a cathode cylinder formed by a cap of a base metal 1 and a cylinder 2 so that the cathode cylinder is heated. An electron-emissive layer 5 is deposited on a surface of the cap.

The base metal 1 may be a metal including Ni as a major element and containing at least Si. A conventional base metal may be used. More specifically, the base metal is for example Ni or Ni-Cr containing Si and, if desired, containing Mg, W, Zr, Al or the like. The content of Si is preferably 0.01 to 0.1 wt. % in the base metal.

The cylinder 2 is not limited to any particular material. Any material conventionally used for a cathode cylinder may be used and it is for example Ni-Cr.

The electron-emissive layer 5 is a layer comprising an alkaline earth metal oxide as a major component containing at least Ba. In this layer, there are dispersed 0.1 to 20 wt. %, preferably, 3 to 10 wt. % of dodecahedral $Sc_2O_3$ crystals 4 not containing chlorine atoms as impurity. The dispersed scandium oxide crystals may contain unavoidably broken crystal forms and they contain dodecahedral crystals of preferably more than 50 wt. %, more preferably more than 70 wt. % and particularly preferably more than 90 wt. %. The thickness of the layer 5 is preferably 50 to 200 μm.

If the scandium oxide contains chlorine atoms as impurity, reaction as expressed by the formula V:

$$Ba + 2Cl \rightarrow BaCl_2 \qquad (V)$$

occurs, which causes the donor to be consumed. If the donors are consumed excessively, a slump phenomenon, that is, a considerable decrease in emission current occurs.

The scandium oxide not containing chlorine atoms mentioned in this specification may be the one containing chlorine atoms of an amount not causing any unfavorable influence to the electron emission characteristics of the cathode and the permissible content of chlorine atoms in the scandium oxide is usually less than 100 ppm.

The above mentioned alkaline earth metal oxide is for example an oxide obtained by thermal decomposition of $BaCO_3$, $(Ba, Sr)Co_3$, $(Ba, Sr, Ca)CO_3$ or the like. The content of Ba in the layer is preferably more than 40 wt. %.

Figure 4:
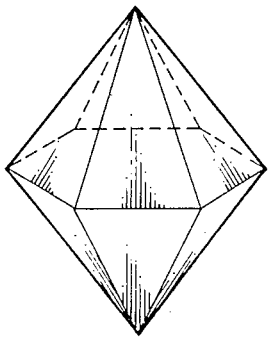
FIG. 4 is a typical view illustrating a dodecahedral crystal structure of scandium oxide.
Figure 5:
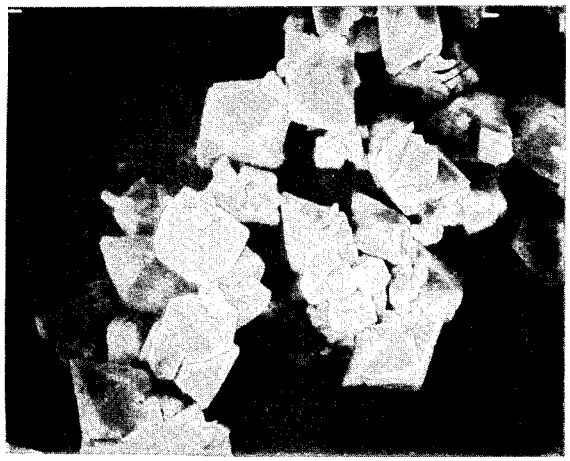
FIG. 5 is an electron micrograph showing the dodecahedral crystal structure of scandium oxide.

The dodecahedral crystal of $Sc_2O_3$ has a crystal structure as shown in FIG. 4. FIG. 5 is an electron micrograph showing dodecahedral crystals of $Sc_2O_3$. An average grain size of the crystals of $Sc_2O_3$ is preferably in the range of 5 to 50 μm. If the average grain size is less than 5 μm, the crystals of $Sc_2O_3$ are liable to fill the gaps in the electron-emissive layer. On the other hand, if the average grain size exceeds 50 μm, the crystals of $Sc_2O_3$ are liable to sink when the electron-emissive layer is formed by a spray process, causing an unfavorable condition of dispersion in the layer.

Scandium oxide $Sc_2O_3$ having the dodecahedral crystal form can be deposited in a manner in which scandium hydroxide is dissolved in hydrochloric acid HCl and ammonium oxalate $C_2O_4(NH_4)_2$ is added to the solution. Chlorine as impurity contained, if any, in the deposited scandium oxide crystals can be removed by rinsing and baking.

Figure 6:
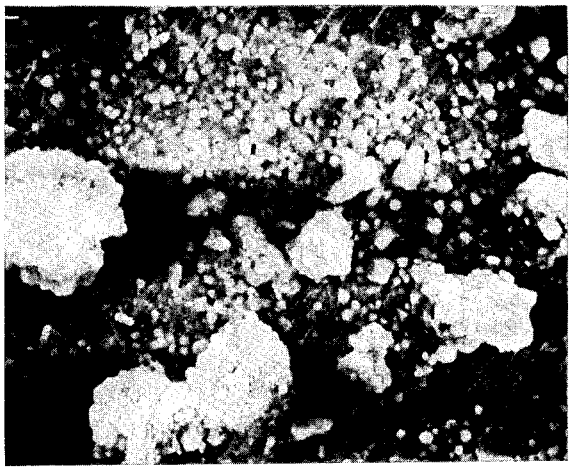
FIG. 6 is an electron micrograph showing a crystal structure of scandium oxide obtained by deposition using ammonium carbonate.

On the other hand, scandium oxide deposited by dissolution in nitric acid $HNO_3$ and addition of ammonium carbonate $(NH_4)_2CO_3$ thereto has substantially spherical fine crystals as shown in the electron micrograph in FIG. 6. Those spherical fine crystals are not desirable since they are liable to fill the gaps in the electron-emissive layer.

If the content of $Sc_2O_3$ is less than 0.1 wt. % in the electron-emissive layer, deterioration of the electron emission characteristics cannot be prevented satisfactorily under the operation condition with a high-current density and if the content is more than 20 wt. %, a sufficient amount of initial emission current cannot be obtained.

The electron-emissive layer can be formed by electrodeposition, application, spraying or other processes. Among those methods, the spraying process is the most preferred because it is important to form a porous layer for the purpose of obtaining good electron emission characteristics. For example, the spraying process is applied in the following manner. A suspension is obtained by mixing $BaCO_3$ and $Sc_2O_3$ in nitrocellulose solution dissolved in an organic solvent and the suspension is sprayed on the base so that the electron-emissive layer is deposited thereon.

The cathode coated with the $BaCO_3$ and $Sc_2O_3$ powder is positioned in an electron tube and it is heated up to about 1000° C. by the heater 3 in an evacuation process for evacuating the electron tube. As a result, $BaCO_3$ is thermally decomposed as expressed by the following formula I.

$$BaCO_3 \rightarrow BaO + CO_2 \quad \text{(I)}$$

On that occasion, the nitrocellulose is also thermally decomposed to be a gas, which is removed together with $CO_2$ outside the tube. As a result of the reaction, $BaCO_3$ is converted to BaO constituting the electron-emissive layer 5.

Figure 7:
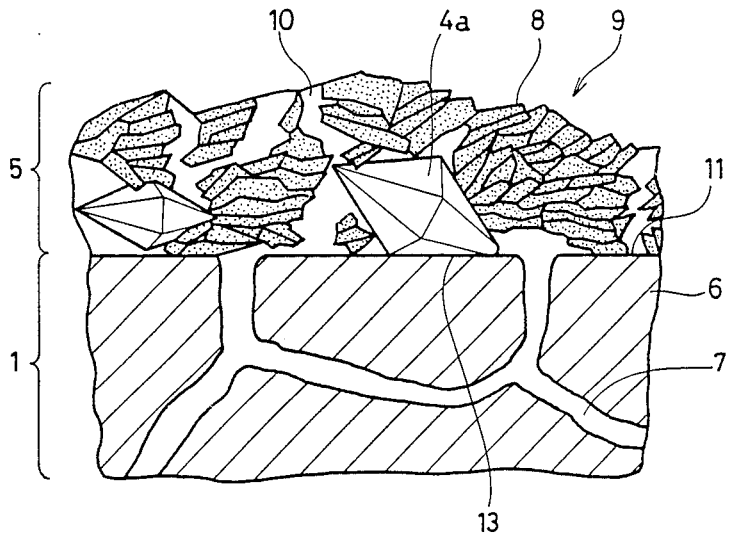
FIG. 7 is an enlarged fragmentary sectional view of the cathode according to the above mentioned embodiment.

FIG. 7 is an enlarged fragmentary view of a section near the interface region 11 in the cathode of FIG. 3. The barium oxide BaO of the electron-emissive layer 5 is in the form of aggregates 9 of several μm to several tens of μm in size formed by gathering of prismatic small crystals 8. The electron-emissive layer 5 has desirably porosity with suitable gaps 10 between the aggregates to ensure good electron emission characteristics. The gaps 10 are substantially defined when $BaCO_3$ is deposited. Dodecahedral crystals 4a of $Sc_2O_3$ are dispersed in the electron-emissive layer 5.

The reducing agent Si or Mg is diffused through the grain boundaries 7 of the crystal grains 6 of Ni in the base metal 1 and reaction expressed by the formula II:

$$2BaO + Si \rightarrow 2Ba + SiO_2 \quad \text{(II)}$$

is caused to occur in the interface region 11. The free Ba serves as the donor for emission of electrons.

At the same time, reaction expressed by the following equation IV:

$$SiO_2 + 2BaO \rightarrow Ba_2SiO_4 \quad \text{(IV)}$$

also occurs.

Thus, Ba as the donor is generated in the interface region 11 between the electron-emissive layer 5 and the base metal 1 and it is moved through the gaps between the aggregates 9 of the layer 5 onto its upper surface so as to emit electrons. However, since the free Ba is evaporated or consumed as a result of reaction with residual gas such as CO, $CO_2$ or $O_2$ in the electron tube, it is necessary to constantly supply Ba by effecting the above described reactions. In order to maintain a good balance between the supply and the consumption of Ba, it is desired to maintain the cathode at about 800° C. during its operation.

The dodecahedral crystals of $Sc_2O_3$ dispersed in the electron-emissive layer 5 hardly fill the gaps 10 and, instead, they are liable to form the gaps 10. As is easily understood from FIGS. 3 and 4, the structure of the dodecahedral crystal 4a of $Sc_2O_3$, makes it easy to bring a surface 13 thereof into contact with the base metal 1 and accordingly the below described advantages are involved.

It is believed that the reaction product $Ba_2SiO_4$ indicated in the formula IV reacts with $ScNi_5$ obtained by the reaction expressed by the formula V:

$$Sc_2O_3 + 10Ni \rightarrow 2ScNi_5 + 3O \quad \text{(V)}$$

in the manner expressed by the formula VI:

$$9Ba_2SiO_4 + 16ScNi_5 \rightarrow 4Ba_3Sc_4O_9 + 6Ba + 9Si + 80Ni \quad \text{(VI)}$$

so that it is decomposed. Thus, it is understood that accumulation of $Ba_2SiO_4$ in the interface region 11 between the electron-emissive layer 5 and the base metal 1 hardly occurs.

Consequently, there is no such barrier against diffusion of the reducing agent of Si or the like as in the conventional cathode caused by the accumulation of the reaction product of $Ba_2SiO_4$ or the like in the interface region 11 and it never becomes difficult to generate free Ba. In addition, since there is no interface layer of high resistance value, electron emission current is not obstructed and the cathode can be operated with a high current density. In addition, as is different from the case of an electron-emissive layer where substantially spherical grains of $Sc_2O_3$ deposited by using $(NH_4)_2CO_3$ are dispersed, the porous electron-emissive layer can be formed and accordingly free Ba can be easily supplied, which makes it possible to obtain a sufficient amount of electron emission current. Moreover, the process for decomposition and activation of electron emitting materials may be the same as in the conventional case and accordingly the manufacturing process of an electron tube may be the same as in the conventional case.

EXAMPLE 1 AND COMPARISON

Scandium hydroxide was dissolved in a solution of HCl and $C_2O_4(NH_4)_2$ was added thereto so that $Sc_2O_3$ was deposited. Thus, grains of $Sc_2O_3$ having an average grain diameter of 20 μm were obtained with more than 90 wt. % of dodecahedral crystals.

Then, a suspension was prepared by mixing $BaCO_3$ and $Sc_2O_3$ into a solution of nitrocellulose dissolved in an organic solvent to cause the content of the above mentioned grains of $Sc_2O_3$ in an electron-emissive layer to be 5 wt. % after completion of a cathode. Using the suspension, a layer to be an electron-emissive layer was formed to a thickness of about 100 μm by the spraying method on a surface of a base metal of Ni containing 0.03 wt. % of Si and 0.05 wt. % of Mg and, after an evacuation process and an activation process, a cathode as shown in FIG. 7 was prepared.

One or more cathodes thus obtained and one or more conventional cathodes for comparison, similar to the example 1 except that an electron-emissive layer not containing $Sc_2O_3$ was provided, were placed in a color cathode ray tube for three primary colors. Then, manufacturing of the electron tube was completed through the ordinary evacuation and activation processes.

The electron tube thus manufactured was subjected to a life test for 6000 hours under a forced acceleration condition with a current density of $3A/cm^2$ so as to examine deterioration of electron emission current. The electron emission current of the conventional cathode not containing dispersed $Sc_2O_3$ was decreased to 50% of the initial emission current after the test of 6000 hours, while the electron emission current of the cathode of the present invention was maintained to 70% of the initial emission current after 6000 hours. This means that the cathode of the example 1 had a life about 2.5 times longer than that of the conventional cathode used for comparison.

In addition, several tens thousand of cathodes of the example 1 were manufactured and they were subjected to performance tests after the electron tube manufacturing process. As a result, it was found that the yeild of the cathodes attaining a desired electron emission rate was more than 99%. Thus, any of the cathodes of the example 1 had stable electron emission characteristics.

EXAMPLES 2 AND 3

Cathodes of the examples 2 and 3 were prepared in the same manner as in the example 1, except that the content of $Sc_2O_3$ in an electron-emissive layer was changed as shown in Table 1.

Those cathodes were subjected to life tests for 6000 hours in the same manner as in the example 1. Table 1 shows the results.

TABLE 1

| Example | Content of $Sc_2O_3$ (%) | Deterioration ratio with respect to initial current (%) |
|---|---|---|
| 1 | 5 | 70 |
| 2 | 3 | 70 |
| 3 | 10 | 70 |

In addition, large numbers of cathodes of the respective examples 2 and 3 were manufactured and tested. As a result, it was found that any of the cathodes has stable electron emission characteristics.

Figure 8:
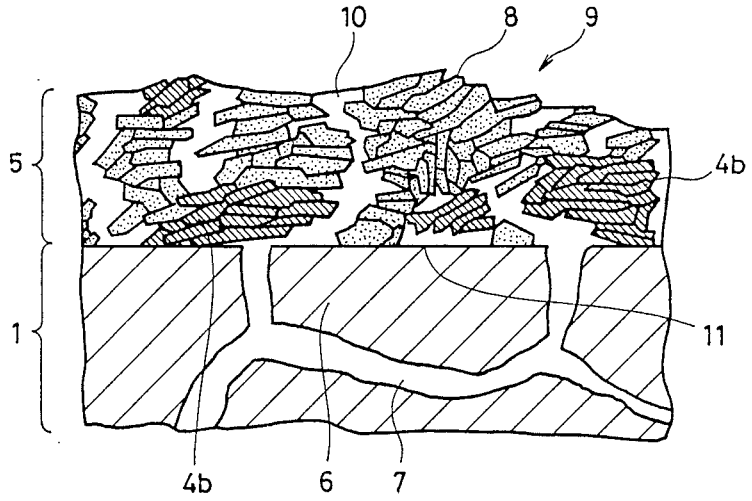
FIG. 8 is an enlarged fragmentary sectional view of a cathode for an electron tube according to another embodiment of the present invention.

FIG. 8 is an enlarged fragmentary sectional view of a cathode for an electron tube according to another embodiment of the present invention. The cathode of FIG. 8 is similar to that of FIG. 7, except that prismatic polyhedral crystals 4*b* of $Sc_2O_3$ are dispersed in the electron-emissive layer 5 in place of the dodecahedral crystals 4*a* of $Sc_2O_3$.

Figure 9:
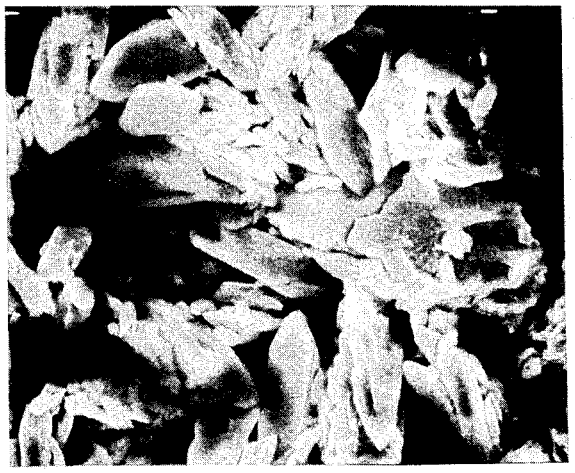
FIG. 9 is an electron micrograph showing a prismatic polyhedral crystal structure of scandium oxide.

The prismatic polyhedral crystals of $Sc_2O_3$ can be deposited by adding $C_2O_4H_2$ to a solution of $HNO_3$ containing Sc. In this case, there is no fear of chlorine being contained as impurity in the scandium oxide crystals. In addition, since the prismatic polyhedral crystals of $Sc_2O_3$ have a crystal form similar to the crystal form of BaO, those $Sc_2O_3$ crystals can be easily dispersed in the electron-emissive layer 5. FIG. 9 is an electron micrograph showing $Sc_2O_3$ having such prismatic polyhedral crystal form.

EXAMPLE 4

Scandium hydroxide was dissolved in a solution of $HNO_3$ and $C_2O_4H_2$ was added thereto, whereby $Sc_2O_3$ was deposited. Thus, grains of $Sc_2O_3$ having an average grain size of 10 μm with more than 90 wt. % of prismatic polyhedral crystals not containing chlorine atoms were obtained.

A cathode having an electron-emissive layer containing 5 wt. % of such prismatic polyhedral crystals of $Sc_2O_3$ was prepared in the same manner as in the example 1. The cathode of the example 4 was subjected to a life test for 6000 hours with a current density of $3A/cm^2$. As a result, it was found that the cathode of the example 4 has also the same excellent characteristics as in the cathode of the example 1.

As described in the foregoing, the cathode for an electron tube according to the present invention has an electron-emissive layer where $Sc_2O_3$ having a dodecahedral or prismatic polyhedral crystal form is dispersed in an alkaline earth metal oxide, on a surface of a base metal containing at least Si as the reducing agent and, thus, the cathode exhibits stable electron emission characteristics for a long period. In addition, the cathode of the present invention exhibits the stable electron emission characteristics with good reproducibility.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A cathode for an electron tube, comprising:

a base including nickel as a major element and including at least silicon as a reducing agent contained in said base, and an electron-emissive layer coated on said base, said electron emissive layer comprising an alkaline earth metal oxide containing barium and scandium oxide, said scandium oxide being in the form of dodecahedral crystals and dispersed in said electron-emissive layer in the range from 0.1 to 20 wt. %.

2. A cathode in accordance with claim 1, wherein said dodecahedral crystals of said scandium oxide are deposited by addition of ammonium oxalate to a solution of hydrochloric acid containing scandium.

3. A cathode in accordance with claim 2, wherein said dodecahedral crystals of said scandium oxide are baked for the purpose of removing residual chlorine.

4. A cathode in accordance with claim 1, wherein said crystals of said scandium oxide have an average grain size in the range from 5 to 50 μm.

5. A cathode for an electron tube, comprising;

a base including nickel as a major element and including at least silicon as a reducing agent contained in said base, and an electron-emissive layer coated on said base, said electron-emissive layer comprising an alkaline earth metal oxide containing barium and scandium oxide, said scandium oxide being prismatic polyhedral crystals and dispersed in said electron-emissive layer in the range from 0.1 to 20% wt. %.

6. A cathode in accordance with claim 5, wherein said prismatic polyhedral crystals of said scandium oxide are deposited by addition of oxalic acid to a solution of nitric acid containing scandium.

7. A cathode in accordance with claim 5, wherein said crystals of said scandium oxide have an average grain size in the range from 5 to 50 μm.

* * * * *